US010144120B2

(12) United States Patent
Segura

(10) Patent No.: US 10,144,120 B2
(45) **Date of Patent: *Dec. 4, 2018**

(54) FASTENER DRIVING TOOL WITH AN AUTOMATIC NOSE CHAMBER GUIDE MEMBER

(71) Applicant: Illinois Tool Works Inc., Glenview, IL (US)

(72) Inventor: Ricardo Segura, Lake in the Hills, IL (US)

(73) Assignee: Illinois Tool Works Inc., Glenview, IL (US)

( * ) Notice: Subject to any disclaimer, the term of this patent is extended or adjusted under 35 U.S.C. 154(b) by 98 days.

This patent is subject to a terminal disclaimer.

(21) Appl. No.: 15/386,542

(22) Filed: Dec. 21, 2016

(65) Prior Publication Data

US 2017/0100826 A1 Apr. 13, 2017

Related U.S. Application Data

(63) Continuation of application No. 14/073,021, filed on Nov. 6, 2013, now Pat. No. 9,527,196.

(51) Int. Cl.

| | |
|---|---|
| ***B25C 1/00*** | (2006.01) |
| ***B25C 5/16*** | (2006.01) |
| ***B25C 1/18*** | (2006.01) |

(52) U.S. Cl.

CPC ..... *B25C 1/001* (2013.01); *B25C 1/005* (2013.01); *B25C 1/008* (2013.01); *B25C 1/184* (2013.01); *B25C 5/16* (2013.01)

(58) Field of Classification Search

CPC ..... B25C 1/00; B25C 1/001; B25C 1/005; B25C 1/008; B25C 1/04; B25C 1/184; B25C 5/16; B25C 5/162

(Continued)

(56) References Cited

U.S. PATENT DOCUMENTS

| | | |
|---|---|---|
| 3,552,274 A | 1/1971 | Bojan |
| 3,815,475 A | 6/1974 | Howard et al. |

(Continued)

OTHER PUBLICATIONS

International Search Report and Written Opinion for International Application No. PCT/US2014/052204, dated Dec. 4, 2014 (8 pages).

(Continued)

*Primary Examiner* — Scott A Smith

(74) *Attorney, Agent, or Firm* — Neal, Gerber & Eisenberg LLP

(57) ABSTRACT

A fastener driving tool with an improved nose chamber guide member is provided for driving fasteners of at least two different lengths. Multiple fasteners in a magazine are guided toward a driving bore to be driven by a driver blade. A nosepiece defines a passageway of the fasteners. The guide member is operatively connected to the nosepiece and is configured for transitioning between a first position and a second position relative to the nosepiece in a direction transverse to an operational flow direction of the fasteners. In the first position, the guide member is disposed to align with the driving bore for allowing driving of the fasteners having a first length. In the second position, the guide member is disposed out of alignment with respect to the driving bore for allowing driving of the fasteners having a second length, which is longer than the first length.

21 Claims, 7 Drawing Sheets

(58) Field of Classification Search
USPC .... 227/8, 109, 119, 120, 123, 136, 129, 130
See application file for complete search history.

(56) References Cited

U.S. PATENT DOCUMENTS

| | | | |
|---|---|---|---|
| 3,834,602 | A | 9/1974 | Obergfell |
| 4,174,802 | A | 11/1979 | Maestri |
| 4,304,349 | A | 12/1981 | Novak |
| 4,389,012 | A | 6/1983 | Grikis |
| 4,403,722 | A | 9/1983 | Nikolich |
| 4,483,473 | A | 11/1984 | Wagdy |
| 4,483,474 | A | 11/1984 | Nikolich |
| 4,932,480 | A | 6/1990 | Golsch |
| 5,197,646 | A | 3/1993 | Nikolich |
| 5,263,439 | A | 11/1993 | Doherty et al. |
| 5,335,800 | A | 8/1994 | Liu |
| 5,437,404 | A | 8/1995 | Shkolnikov |
| 5,452,835 | A | 9/1995 | Shkolnikov |
| 5,813,588 | A | 9/1998 | Lin |
| 6,053,389 | A | 4/2000 | Chu |
| 6,279,808 | B1 | 8/2001 | Larsen |
| 6,729,524 | B1 | 5/2004 | Yao |
| 6,739,490 | B1 | 5/2004 | Shkolnikov |
| 6,808,101 | B2 | 10/2004 | Laubach et al. |
| 7,028,875 | B1 | 4/2006 | Beville |
| 7,172,103 | B2 | 2/2007 | Fujiyama |
| 7,516,876 | B2 | 4/2009 | Ohmori |
| 7,628,304 | B2 | 12/2009 | Yamamoto |
| 9,486,904 | B2 * | 11/2016 | Gregory ..... B25C 1/00 |
| 9,498,871 | B2 * | 11/2016 | Gregory ..... B25C 1/008 |
| 9,527,196 | B2 * | 12/2016 | Segura ..... B25C 1/005 |
| 9,796,072 | B2 | 10/2017 | Young |
| 9,827,658 | B2 * | 11/2017 | Gregory ..... B25C 1/001 |
| 9,925,652 | B2 * | 3/2018 | Foser ..... B25C 1/001 |
| 2003/0094477 | A1 | 5/2003 | Chen |
| 2004/0084499 | A1 | 5/2004 | Tsai |
| 2008/0093410 | A1 | 4/2008 | Canlas |
| 2008/0251565 | A1 | 10/2008 | Chou |
| 2010/0206934 | A1 | 8/2010 | Vallon et al. |

OTHER PUBLICATIONS

New Zealand First Examination Report for New Zealand Application No. 733142, dated Apr. 6, 2018 (4 pages).

Canadian Office Action for Canadian Application No. 2,924,047, dated Jan. 27, 2017 (4 pages).

* cited by examiner

FASTENER DRIVING TOOL WITH AN AUTOMATIC NOSE CHAMBER GUIDE MEMBER

PRIORITY CLAIM

This patent application is a continuation of and claims priority to and the benefit of U.S. patent application Ser. No. 14/073,021, which was filed on Nov. 6, 2013, now U.S. Pat. No. 9,527,196, the entire contents of which are incorporated herein by reference.

BACKGROUND

The present disclosure generally relates to fastener driving tools, and specifically to such tools designed to operate with fasteners of varying sizes. The present driving tool automatically adjusts to differently sized fasteners to reduce jamming, thereby making the tools easier to use and having more accurate fastener delivery.

Power fastener driving tools are well known. Conventional driving tools are usually portable and are powered pneumatically or by combustion. Sample pneumatic tools are described in U.S. Pat. Nos. 4,932,480; 3,552,274; and 3,815,475, all of which are incorporated by reference. Combustion powered tools are described in commonly assigned U.S. Pat. Nos. 4,403,722; 4,483,473; 4,483,474; 5,197,646; and 5,263,439, all of which are incorporated by reference.

Such tools incorporate a tool housing enclosing the power source, such as a pneumatic cylinder or a small internal combustion engine. In combustion tools, the engine is powered by a canister of pressurized fuel gas also called a fuel cell. Power is generated from expansion of compressed gasses, either by burning of fuel in a combustion chamber or expansion of air in the pneumatic cylinder. Conventionally, a reciprocating piston having an elongated driver blade is actuated by the power source to drive the fasteners into workpieces. In most tools, an interlock prevents firing of the tool unless a workpiece contact element at the end of a nosepiece, or nosepiece assembly, is pressed against a workpiece.

Typically, the fasteners are collated into a strip and positioned within a feed slot or track in a magazine for sequentially advancing each fastener into a driving position within a driving bore of the tool. A shear block or guide surface is provided between the magazine and the bore for separating one fastener from adjacent fasteners in the magazine while guiding the fastener into the bore as being driven. While the tool and the magazine can accommodate nails of different lengths, substantially short nails can occasionally slightly tip or tumble near the magazine feed slot as the fasteners are being driven due to tool orientation, vibrations and unwanted movements of the tool. Such movements cause inaccurate driving of the fasteners and sporadic jamming of the fasteners within the tool.

One way to reduce tumbling and/or jamming of short fasteners is to provide a pivoting flap or lever in the magazine and shear block for guiding different length fasteners. Exemplary models of a fastener-size adjustment device are described in commonly assigned U.S. Pat. Nos. 5,437,404 and 6,808,101, both of which are incorporated by reference. With both of the above-referenced patents, the adjustment device is pivotally connected to the shear block and care must be taken to insure that a gap between the fastener and the adjustment device does not exist. This gap causes the tumbling and jamming of the short fasteners within the tool. However, it is difficult to reduce the gap automatically based on different lengths of the fasteners, and occasionally a user has to rotate the adjustment device manually to clear and prevent the jamming of the short fasteners. Therefore, there is a need for improving the adjustment device to accommodate fasteners of different lengths and prevent the tumbling and jamming of the short or smaller fasteners as they are being driven without requiring manual user intervention.

SUMMARY

The present disclosure is directed to an automatic, adjustable nose chamber guide member for guiding fasteners of at least two different lengths as they are driven by a fastener driving tool. Specifically, the present nose chamber guide member automatically adjusts the size of a nosepiece opening based on a fastener length.

One aspect of the machine is that, as described in further detail below, there is no need for a user to manipulate the present nose chamber guide member while using the fastener driving tool. A consistent biasing action of the present guide member against an inner wall of a nosepiece provides continuous size adjustment between short and long fasteners. Thus, a gap between the fasteners and the present guide member is reduced automatically when shorter fasteners are present.

Another important aspect is that the present guide member is not susceptible to manufacturing tolerance issues. More specifically, the present nose chamber guide member accommodates fasteners of different lengths without having to meet strict tolerance limits and specifications. Unlike pivoting devices that require a perfect alignment of mating surfaces between adjacent moving elements, the present nose chamber guide member is actuated with generous tolerance limits. For example, the present guide member extends and retracts in a transverse direction to the direction of fasteners travelling in the nosepiece. This movement of the present guide member for aligning and guiding the fasteners into a driving bore are achieved without strenuous, narrow manufacturing tolerance limits.

In one embodiment, a fastener driving tool with an improved nose chamber guide member is provided for driving fasteners of at least two different lengths. Multiple fasteners in a magazine are guided toward a driving bore to be driven by a driver blade. A nosepiece bore a passageway of the fasteners. The guide member is operatively connected to the nosepiece and is configured for transitioning between a first position and a second position relative to the nosepiece in a direction transverse to an operational flow direction of the fasteners. In the first position, the guide member is disposed to align with the driving bore for allowing driving of the fasteners having a first length. In the second position, the guide member is disposed out of alignment with respect to the driving bore for allowing driving of the fasteners having a second length, which is longer than the first length.

In another embodiment, a nosepiece and nose chamber guide assembly is provided for a fastener driving tool that drives a fastener supplied from a magazine having a plurality of fasteners. A nosepiece is configured for attachment to the fastener driving tool and defining a portion of a bore. The bore has an opening for accommodating the fastener. A member is disposed adjacent the opening where the guide member is movably connected to the nosepiece and configured for transitioning between a first position and a second position relative to the nosepiece. In the first position, the member is substantially in alignment with an inner wall of the nosepiece defining the bore for guiding the fastener having a first length. In the second position, the member is out of alignment with the inner wall for guiding the faster having a second length, which is longer than the first length.

DETAILED DESCRIPTION

Figure 1:
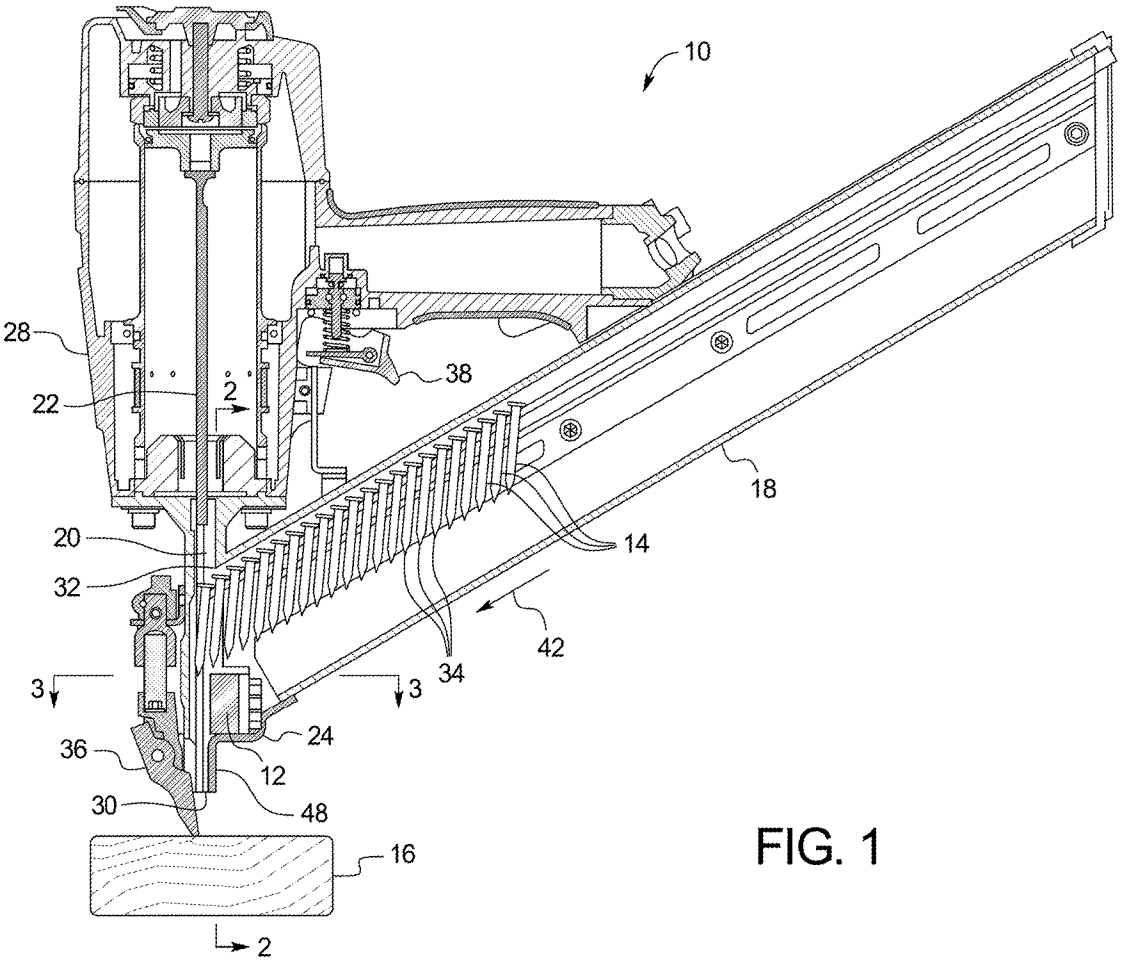
FIG. 1 is a vertical cross-section of a fastener driving tool featuring the present nose chamber guide member having short fasteners in a magazine.
Figure 2:
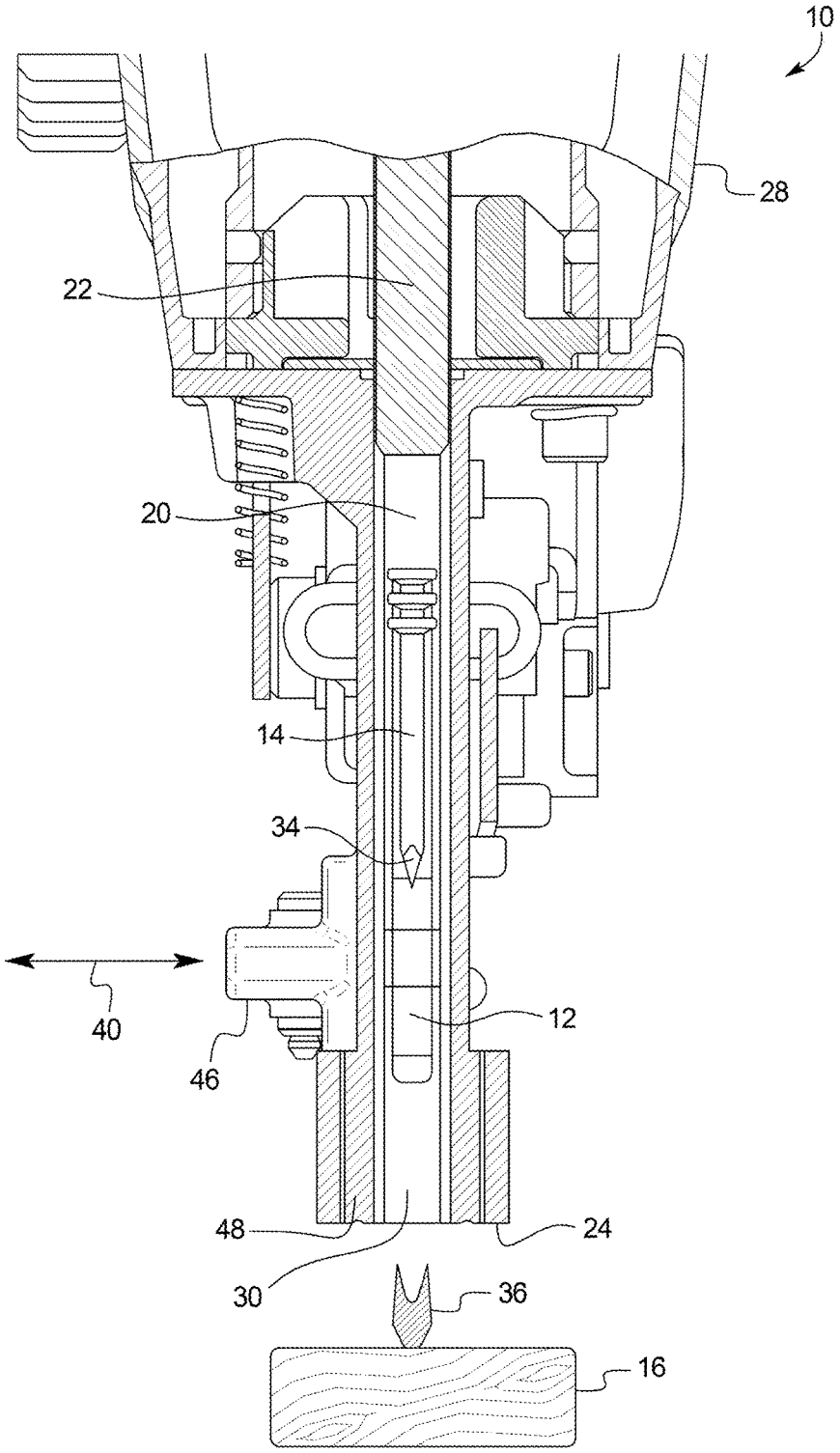
FIG. 2 is a fragmentary cross-section taken along the line 2-2 of FIG. 1 and in the direction generally indicated.
Figure 3:
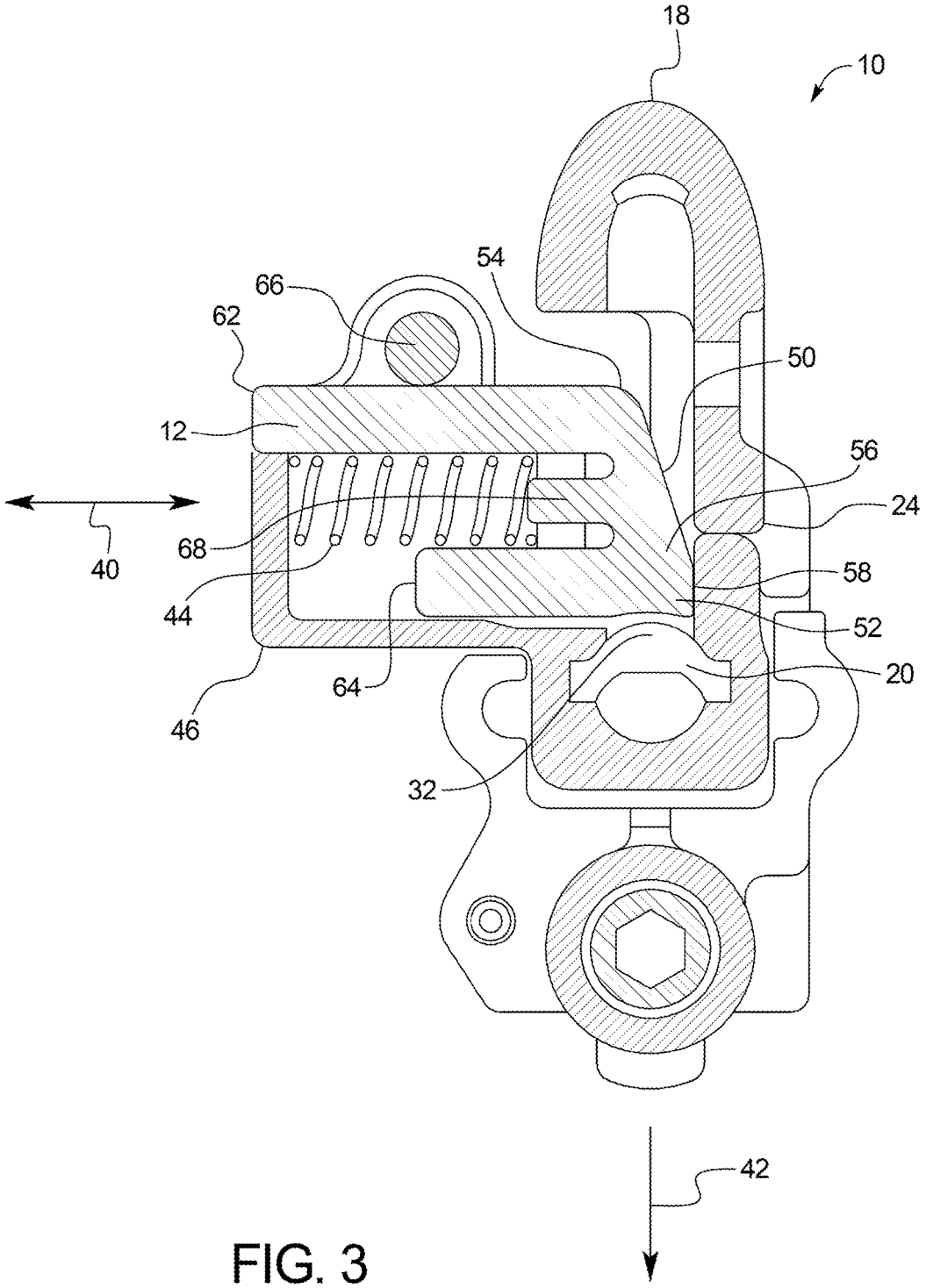
FIG. 3 is a cross-section taken along the line 3-3 of FIG. 1 and in the direction generally indicated.
Figure 4:
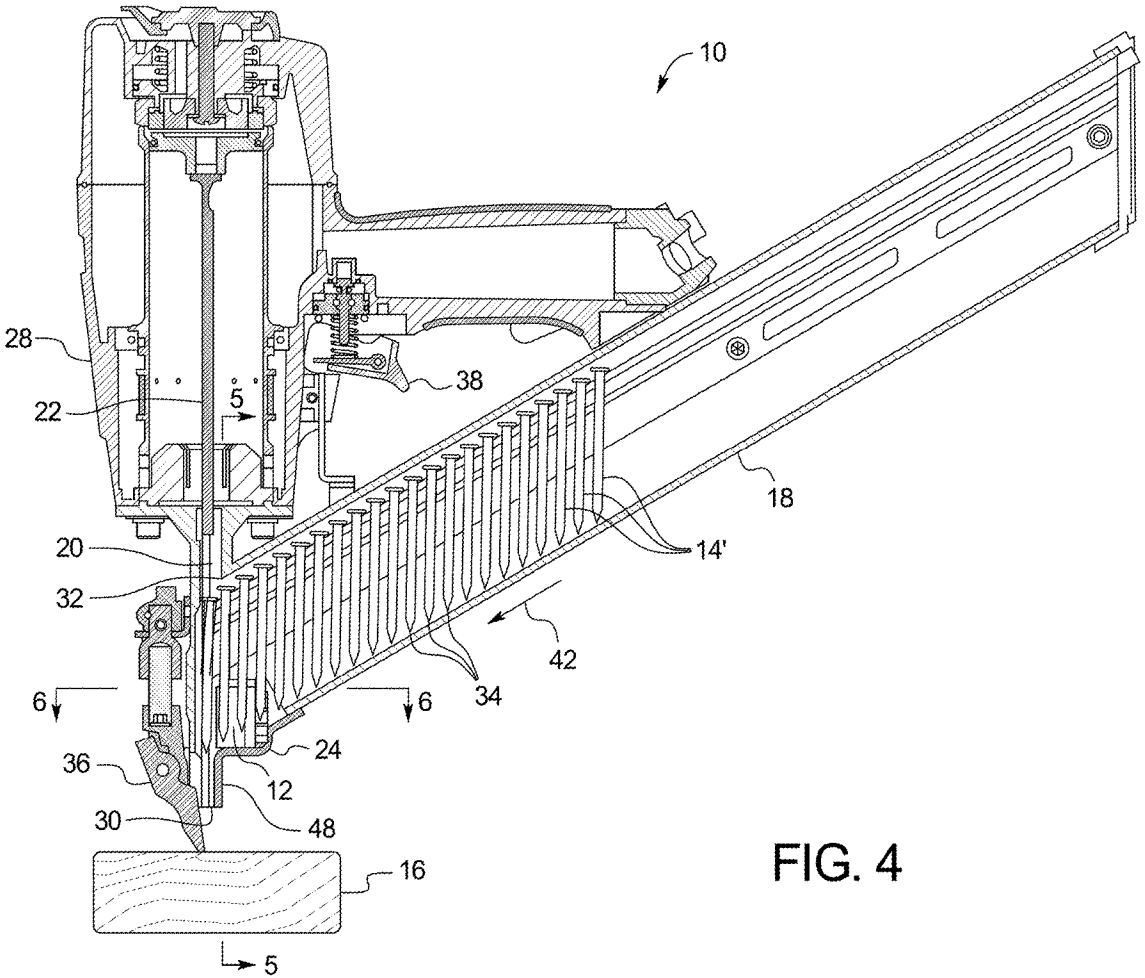
FIG. 4 is a vertical cross-section of the present driving tool having long fasteners in the magazine.

Referring now to FIGS. 1-3, a fastener driving tool is generally designated 10. Such tools are generally well-known in the art, and are described in the above-listed patents incorporated by reference. The present tool 10 is shown with a nose chamber guide member 12. Tools powered by combustion, compressed air and electric motors are contemplated for use with the present nose chamber guide member. During a nailing or framing operation, the tool 10 is commonly used for driving a fastener 14 into a workpiece 16. Generally, multiple fasteners 14 are sequentially loaded into a magazine 18 that is in some cases removably attached to the tool 10. Although a nail-type fastener is shown for illustration purposes, any type of fastener that is satisfactorily driven into the workpiece 16 is contemplated, such as brads, staples, tacks and other types known in the art.

A strip of the fasteners 14 is accommodated in the magazine 18 and successively guided toward a driving bore or passageway 20 having a shape of preferably tubular barrel to be driven by a driver blade 22. The present magazine 18 is configured for accommodating strips of at least two different lengths of fasteners 14 and 14' (short and long, unless indicated otherwise, "14" will apply to all lengths). Each fastener 14 is sequentially advanced into a driving position within the driving bore or passageway 20. A nosepiece 24 at least partially defines the passageway 20. The bore 20 extends from the resting position of the driver blade 22 near a body 28 of the tool 10 to an exit 30.

A rear opening 32 of the bore 20 receives the fasteners 14 from the magazine 18 oriented such that a lower portion or tip 34 of each fastener is facing the workpiece 16 and the fastener is oriented to be generally parallel with the bore. When the tool 10 is in contact with the workpiece 16 via a work contacting element (WCE) 36, which is mechanically connected to a trigger 38, in order to drive a fastener, the trigger 38 is activated by a user. At that moment, the driver blade 22 rapidly travels through the bore 20 and drives the fastener 14 through the remaining length of the bore into the workpiece 16.

Following the driving of the fastener 14, as the driver blade 22 retracts up the length of the bore 20 and moves upwardly past the opening 32, the next fastener is forced into the bore by the spring-loaded clip or magazine 18. At the next actuation of the trigger 38, the driver blade 22 travels downwardly in the bore 20 to push down the following fastener 14 into the workpiece 16. However, in conventional tools, when short fasteners 14 (FIGS. 1-3) are used, they can rotate through the opening 32, blocking the bore 20 below a lower or tip portion 34 of the next fastener 14. This causes jamming of the fasteners 14 and blocks the opening 32, thereby interrupting a smooth operational flow of successive fasteners, and requiring disruptive maintenance and/or disassembly of the tool 10.

An important aspect of the present member 12 is that the guide member allows the tool 10 to automatically adjust to different length fasteners. For example, as the fasteners 14 are fed from the magazine 18, the improved guide member 12 operatively connected to the nosepiece 24 transitions between a first position and a second position relative to the nosepiece in a direction 40 transverse or generally perpendicular to an operational flow or feeding direction 42 of the fasteners (FIG. 3). Preferably, the present guide member 12 is disposed in a space defined by the nosepiece 24.

Figure 5:
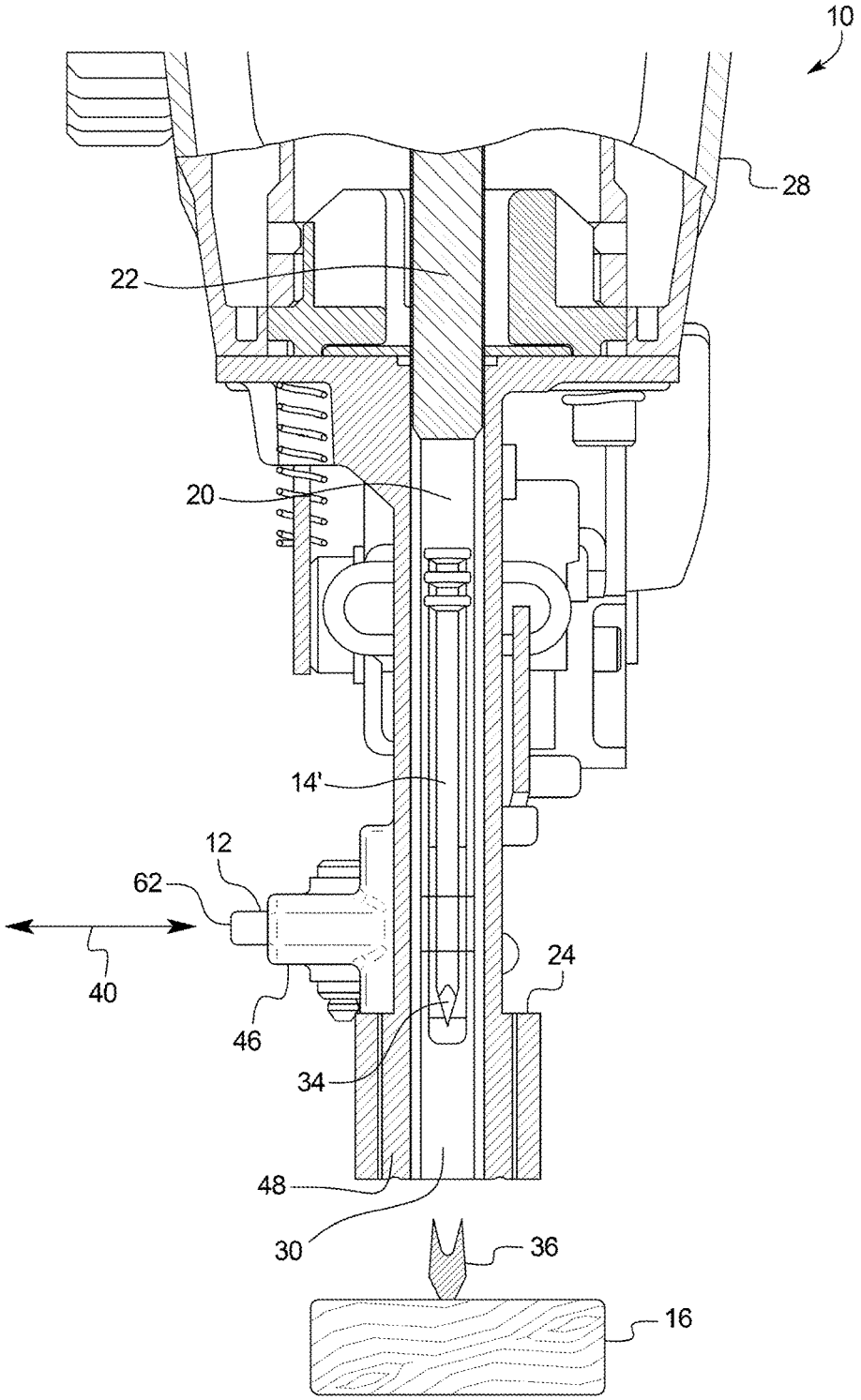
FIG. 5 is a fragmentary cross-section taken along the line 5-5 of FIG. 4 and in the direction generally indicated.
Figure 6:
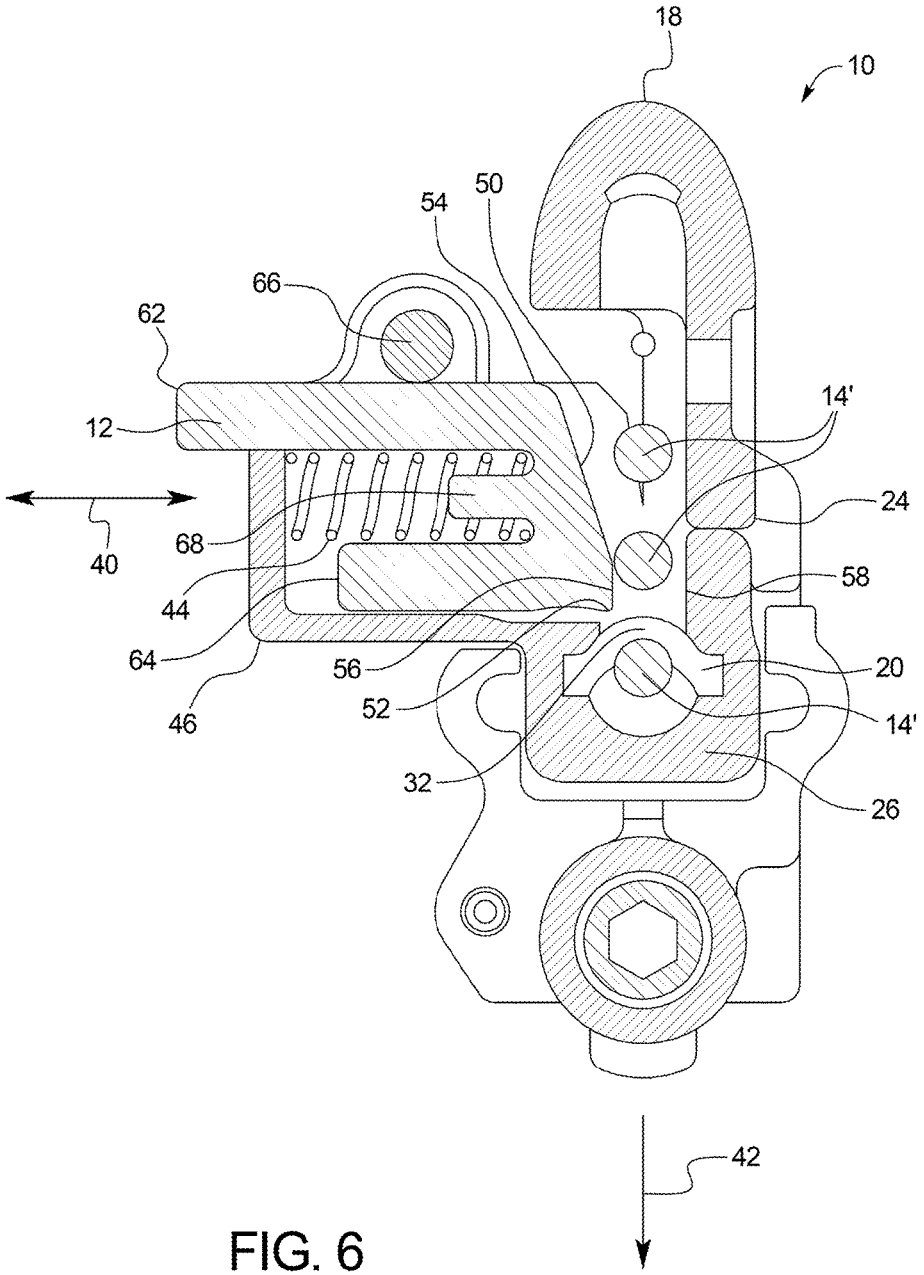
FIG. 6 is a cross-section taken along the line 6-6 of FIG. 4 and in the direction generally indicated.
Figure 7:
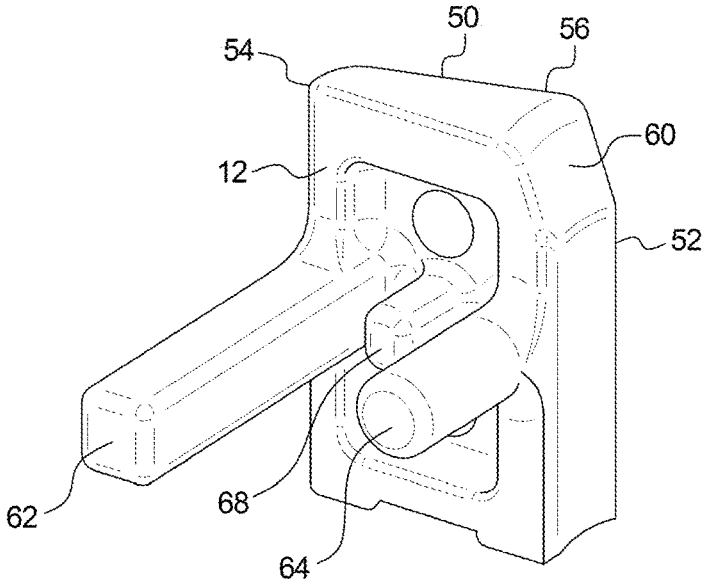
FIG. 7 is a rear perspective view of the present nose chamber guide member incorporating a pair of guide rods.

Referring now to FIGS. 2, 3 and 4-6, when the present nose chamber guide member 12 is in the first position, the guide member aligns with the driving bore 20 for allowing driving of the fasteners 14 having a first length (i.e., short). As best shown in FIG. 3, the short fastener 14 travels downwardly through the bore 20 defined in part by the nosepiece 24 and in part by the guide member 12. On the other hand, when the guide member 12 is in the second position, as best shown in FIG. 6, the guide member 12 is disposed out of alignment with respect to the driving bore 20 for allowing driving of the fasteners 14 having a second length, which is longer than the first length, (i.e., long).

More specifically, the nose chamber guide member 12 automatically extends and retracts based on the first and second lengths of the fasteners 14 at a substantially right angle to a feeding direction 42 of the fasteners in the magazine 18 (FIGS. 3 and 6). For the short fasteners 14, the nose chamber guide member 12 is extended to the first position for guiding the fasteners into the driving bore 20 (FIG. 3). When the guide member 12 is in the first position, at least a portion of the bore 20 is defined by the nosepiece 24 and the nose chamber guide member 12. Preferably, nose chamber guide member 12 transitions into the first position under an action of a return spring 44 (FIG. 3) exerting a biasing force against the guide member.

For the long fasteners 14', the nose chamber guide member 12 is retracted to the second position for guiding the fasteners into the driving bore 20 (FIG. 6). When the guide member 12 is in the second position, at least a portion of the bore 20 is partially defined by the nosepiece 24 alone without the guide member. Specifically, movement of the long fasteners 14' toward the nosepiece 24 forces the nose chamber guide member 12 into the second position, such that the guide member is retracted into a chamber 46 which is attached to the nosepiece 24 and is configured for accommodating the laterally reciprocating guide member. As a constituent part of the nosepiece 24, the chamber 46 is constructed and arranged adjacent to the opening 32 of the bore 20 near a lower portion 48 of the nosepiece.

Referring now to FIGS. 1, 3 and 6-8, an exemplary nose chamber member 12 is illustrated in greater detail. It is preferred that the nose chamber guide member 12 includes a slanted outer face 50 angled from a first edge 52 to an opposite second edge 54 for facilitating movement of the fasteners 14'. More specifically, as the long fasteners 14' move toward the bore 20, the fasteners push a protruding portion 56 of the outer face 50 to overcome the force of the spring 44, such that the guide member 12 is retracted away from an inner wall 58 of the nosepiece 24, thereby forcing the guide member 12 to be in the second position (FIG. 6). However, when the guide member 12 is in the first position, the protruding portion 56 directly biases against the inner wall 58 of the nosepiece 24 under the action of the return spring 44 (FIG. 3).

It is also contemplated that the first edge 52 of the nose chamber guide member 12 defines part of a fastener pathway toward the exit 30 and an upper portion 60 is inclined to facilitate a fastener location in the driving bore 20. The possibility of jamming is reduced by incorporating this feature. For example, as the fastener 14 moves downwardly under the action of the driver blade 22, the lower portion 34 of the fastener is properly guided by the inclined upper portion 60 even if the fastener tips or tumbles near the opening 32.

Referring now to FIGS. 2, 3, 5, and 6-8, further included in the guide member 12 are a first guide rod 62 and a second guide rod 64, where the second guide rod is shorter than the first guide rod. Due to this length difference, the longer guide rod 62 protrudes out of the chamber 46 when the guide member 12 is in the second position, thereby indicating to the user that the long fasteners 14' are used in the tool 10 (FIG. 5). Conversely, the first guide rod 62 recedes into the chamber 46 when the guide member 12 is in the first position (FIG. 2). These rods 62, 64 orient and align the guide member 12 properly to reciprocate within the chamber 46 between the first and second positions under the action of the return spring 44 (FIGS. 3 and 6).

Although, as shown, the first rod 62 has a rectangular prism shape and the second rod 64 has a cylindrical tube shape, any suitable geometric shape, such as a hexagonal prism or a cone shape, is also contemplated. The guide member 12 is operatively connected to the nosepiece 24 for allowing longitudinal movement of the guide member between the first and second positions. Optionally, a support pin 66 (FIG. 6) is disposed within at least one of the chamber 46 and the nosepiece 24 for preventing unwanted movement of the guide member 12 within the tool 10. A guide pin 68 is optionally provided on the guide member 12 for defining a seat for the return spring 44 that biases against the inner wall 58 of the guide member 12.

Figure 8:
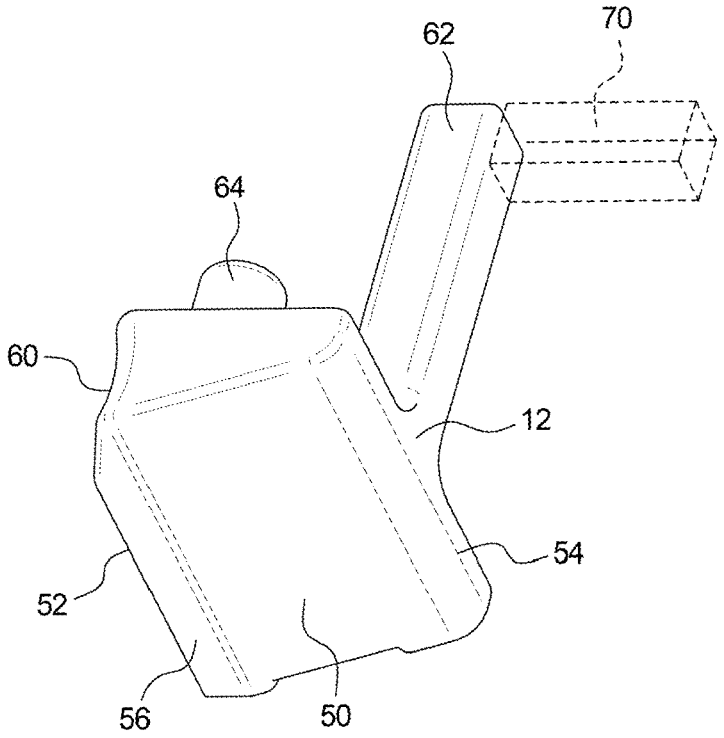
FIG. 8 is a front perspective view of the guide member of FIG. 7.

Further, referring now to FIG. 8, the first rod 62 is optionally provided with a grip bar 70 (shown in phantom), extending transversely, preferably at a right angle to an axis of the first rod 62. While the shape, construction and location of the grip bar 70 may vary with the application, the grip bar facilitates manual clearing of the tool in the event fasteners become lodged in the bore 20, or there are only a few remaining fasteners 14 in the magazine 18. If a jam occurs, the user grasps the grip bar 70 to pull the guide member to the position shown in FIG. 6, opening the bore 20. At the same time, the tool 10 is tilted or oriented so that the previously jammed fastener exits the outlet 30 by gravity.

While a particular embodiment of the present nose chamber guide member has been shown and described, it will be appreciated by those skilled in the art that changes and modifications may be made thereto without departing from the present disclosure in its broader aspects and as set forth in the following claims.

The invention claimed is:

1. A fastener-driving tool comprising:

a magazine sized to house multiple fasteners;

a nosepiece adjacent the magazine, wherein the nosepiece defines a driving bore sized to receive one of the fasteners from the magazine when the magazine houses the fasteners;

a nose chamber guide member supported by the nosepiece and including a first guide rod and a second guide rod that is shorter than the first guide rod, wherein the nose chamber guide member is movable relative to the nosepiece between a first position and a second position in a direction transverse to a feed direction of the fasteners from the magazine to the driving bore; and a biasing element that biases the nose chamber guide member to the first position, wherein when the nose chamber guide member is in the first position, part of the nose chamber guide member is substantially aligned with the driving bore to enable driving of fasteners having a first length, and wherein when the nose chamber guide member is in the second position, the part of the nose chamber guide member is out of alignment with the driving bore to enable driving of fasteners having a second length that is greater than the first length.

2. The fastener-driving tool of claim 1, wherein the biasing element includes a spring.

3. The fastener-driving tool of claim 1, which includes a chamber attached to the nosepiece, wherein at least part of the nose chamber guide member is within the chamber when in both the first position and the second position.

4. The fastener-driving tool of claim 3, wherein at least part of the biasing element is within the chamber.

5. The fastener-driving tool of claim 4, wherein the biasing element contacts and extends between an inner wall of the chamber and the nose chamber guide member.

6. A fastener-driving tool comprising:

a magazine sized to house multiple fasteners;

a nosepiece adjacent the magazine, wherein the nosepiece defines a driving bore sized to receive one of the fasteners from the magazine when the magazine houses the fasteners;

a chamber attached to the nosepiece;

a nose chamber guide member at least partially within the chamber and including a guide rod, wherein the nose chamber guide member is movable relative to the nosepiece between a first position and a second position in a direction transverse to a feed direction of the fasteners from the magazine to the driving bore; and a biasing element that biases the nose chamber guide member to the first position, wherein when the nose chamber guide member is in the first position, part of the nose chamber guide member is substantially aligned with the driving bore to enable driving of fasteners having a first length, and wherein when the nose chamber guide member is in the second position, part of the guide rod protrudes out of the chamber and the part of the nose chamber guide member is out of alignment with the driving bore to enable driving of fasteners having a second length that is greater than the first length.

7. The fastener-driving tool of claim 6, wherein the biasing element includes a spring.

8. The fastener-driving tool of claim 6, wherein at least part of the biasing element is within the chamber.

9. The fastener-driving tool of claim 8, wherein the biasing element contacts and extends between an inner wall of the chamber and the nose chamber guide member.

10. A fastener-driving tool comprising:

a magazine sized to house multiple fasteners;

a nosepiece adjacent the magazine, wherein the nosepiece defines a driving bore sized to receive one of the fasteners from the magazine when the magazine houses the fasteners; and a nose chamber guide member supported by the nosepiece, wherein the nose chamber guide member is movable relative to the nosepiece between a first position and a second position along a linear axis positioned transverse to a feed direction of the fasteners from the magazine to the driving bore;

wherein when the nose chamber guide member is in the first position, part of the nose chamber guide member is substantially aligned with the driving bore to enable driving of fasteners having a first length, and wherein when the nose chamber guide member is in the second position, the part of the nose chamber guide member is out of alignment with the driving bore to enable driving of fasteners having a second length that is greater than the first length.

11. The fastener-driving tool of claim 10, wherein the linear axis is perpendicular to the feed direction of the fasteners from the magazine to the driving bore.

12. The fastener-driving tool of claim 10, which includes a biasing element that biases the nose chamber guide member to the first position.

13. The fastener-driving tool of claim 12, wherein the biasing element includes a compression spring.

14. The fastener-driving tool of claim 10, which includes a chamber attached to the nosepiece, wherein at least part of the nose chamber guide member is within the chamber when in both the first position and the second position.

15. The fastener-driving tool of claim 14, which includes a biasing element that biases the nose chamber guide member to the first position.

16. The fastener-driving tool of claim 15, wherein at least part of the biasing element is within the chamber.

17. The fastener-driving tool of claim 16, wherein the biasing element contacts and extends between an inner wall of the chamber and the nose chamber guide member.

18. The fastener-driving tool of claim 14, wherein the nose chamber guide member includes a guide rod, wherein when the nose chamber guide member is in the second position, the guide rod protrudes from the chamber.

19. The fastener-driving tool of claim 18, wherein the nose chamber guide member includes a grip bar extending transversely from the guide rod.

20. A fastener-driving tool comprising:

a magazine sized to house multiple fasteners;

a nosepiece adjacent the magazine, wherein the nosepiece defines a driving bore sized to receive one of the fasteners from the magazine when the magazine houses the fasteners;

a nose chamber guide member supported by the nosepiece, wherein the nose chamber guide member is movable relative to the nosepiece between a first position and a second position along a linear axis positioned transverse to a feed direction of the fasteners from the magazine to the driving bore;

a chamber attached to the nosepiece, wherein at least part of the nose chamber guide member is within the chamber when in both the first position and the second position; and a biasing element that biases the nose chamber guide member to the first position;

wherein when the nose chamber guide member is in the first position, part of the nose chamber guide member is substantially aligned with the driving bore to enable driving of fasteners having a first length, and wherein when the nose chamber guide member is in the second position, the part of the nose chamber guide member is out of alignment with the driving bore to enable driving of fasteners having a second length that is greater than the first length.

21. A fastener-driving tool comprising:

a magazine sized to house multiple fasteners;

a nosepiece adjacent the magazine, wherein the nosepiece defines a driving bore sized to receive one of the fasteners from the magazine when the magazine houses the fasteners;

a nose chamber guide member supported by the nosepiece, wherein the nose chamber guide member is movable relative to the nosepiece between a first position and a second position along a linear axis positioned transverse to a feed direction of the fasteners from the magazine to the driving bore, and wherein the nose chamber guide member includes a guide rod, wherein when the nose chamber guide member is in the second position, the guide rod protrudes from the chamber; and a chamber attached to the nosepiece, wherein at least part of the nose chamber guide member is within the chamber when in both the first position and the second position;

wherein when the nose chamber guide member is in the first position, part of the nose chamber guide member is substantially aligned with the driving bore to enable driving of fasteners having a first length, and wherein when the nose chamber guide member is in the second position, the part of the nose chamber guide member is out of alignment with the driving bore to enable driving of fasteners having a second length that is greater than the first length.

* * * * *